US006948567B1

(12) United States Patent
Cyphers et al.

(10) Patent No.: US 6,948,567 B1
(45) Date of Patent: Sep. 27, 2005

(54) PASSIVE FIRE PROTECTION DEVICE

(75) Inventors: Daniel C. Cyphers, Enon, OH (US); John P. Haas, Beavercreek, OH (US); Scott A. Frederick, Springboro, OH (US); Doug Hoy, Tipp City, OH (US); Gary Cunagin, Tipp City, OH (US)

(73) Assignee: Skyward, Ltd., Dayton, OH (US)

( * ) Notice: Subject to any disclaimer, the term of this patent is extended or adjusted under 35 U.S.C. 154(b) by 120 days.

(21) Appl. No.: 10/669,082

(22) Filed: Sep. 23, 2003

Related U.S. Application Data

(60) Provisional application No. 60/412,893, filed on Sep. 23, 2002.

(51) Int. Cl.[7] ..... A62C 37/08

(52) U.S. Cl. ..... 169/58; 169/66; 169/62; 169/54

(58) Field of Search ..... 169/54, 58, 62, 169/66, 48, 49, 26, 36

(56) References Cited

U.S. PATENT DOCUMENTS

| | | | | |
|---|---|---|---|---|
| 1,668,940 | A * | 5/1928 | Burke, Jr. | 169/58 |
| 1,745,909 | A * | 2/1930 | Paulus et al. | 169/58 |
| 2,358,848 | A * | 9/1944 | Carter | 169/57 |
| 3,782,475 | A * | 1/1974 | Schmidt | 169/50 |
| 4,251,579 | A * | 2/1981 | Lee et al. | 428/73 |
| 4,763,731 | A * | 8/1988 | Adams et al. | 169/46 |
| 5,490,566 | A * | 2/1996 | Purser | 169/26 |
| 5,678,638 | A * | 10/1997 | Baker | 169/51 |
| 5,762,145 | A * | 6/1998 | Bennett | 169/62 |
| 6,200,664 | B1 * | 3/2001 | Figge et al. | 428/178 |
| 2002/0020536 | A1 * | 2/2002 | Bennett | 169/62 |

FOREIGN PATENT DOCUMENTS

| | | | |
|---|---|---|---|
| GB | 1 454 493 | 11/1976 | |
| GB | 1454493 A * | 11/1976 | A62C 3/12 |

* cited by examiner

*Primary Examiner*—David A. Scherbel
*Assistant Examiner*—James S. Hogan
(74) *Attorney, Agent, or Firm*—Dinsmore & Shohl LLP

(57) ABSTRACT

A fire protection device for holding a fire extinguishing agent. The device is made from a dual-face enclosure coupled to one another through internal ribs, and is configured such that a single chamber defined by the faces and ribs is configured to contain all of the agent. The coupling between the ribs and the two panel faces promotes transfer of an energy source, such as ballistic impact, explosion or excessive temperature, to the front face to promote cracking and subsequent shattering of the front face in a brittle manner. This opening up of the front face releases the fire extinguishing agent in a thorough and well-dispersed manner.

35 Claims, 7 Drawing Sheets

PASSIVE FIRE PROTECTION DEVICE

This application claims the benefit of U.S. Provisional Application No. 60/412,893 filed Sep. 23, 2002.

BACKGROUND OF THE INVENTION

This invention relates generally to a device that upon impact or overheating disperses a fire extinguishing agent to prevent a fire from starting or extinguishing a fire that has already initiated, and more particularly to a passive container for holding the fire extinguishing agent such that one portion of the container preferentially absorbs more of the energy caused by the impact or overheating than other container portions in order to maximize the liberation of the fire extinguishing agent.

Powder panels have been used in ground-based and air-based military applications to provide passive, lightweight, fire protection against ballistic impact, releasing powder into a fire zone to inert the space before adjoining fuel spills into the space and is ignited by incendiaries. Typically, the panels include a hollow or semi-hollow space containing fire extinguishing agent (normally in powder form) that, upon ballistic impact, is released into the environment adjacent the panel. Results from a number of test programs have indicated that powder panels can be an effective, low-cost way to achieve passive fire protection benefits. Some panel designs included numerous honeycomb-shaped cells, each filled with fire extinguishing agent. More recent work has been performed with powder panels to optimize them for automobile applications. These newer designs involved the use of discrete channels, rather than the earlier honeycomb design to achieve a more effective release of powder. Nevertheless, difficulties remain in achieving a thorough liberation of the powder in applications where the damage may be more localized, such as from the aforementioned ballistic projectile. What is needed is a powder panel that is lightweight and inexpensive to manufacture, yet upon absorption of ballistic or thermal energy, is capable of releasing extensive amounts of the fire extinguishing agent.

SUMMARY OF THE INVENTION

The needs are met by the present invention, where a panel is configured to inhibit the formation or propagation of a fire. According to a first aspect of the invention, a fire protection device includes front and rear faces (or surfaces) that are spaced relative to one another by a plurality of ribs that couple the faces together. The ribs and front and rear faces define a single chamber into which a fire extinguishing agent can be disposed. The single-chamber configuration of the present invention is distinguished over approaches that employ numerous discrete chambers (including, for example, channel- and honeycomb-based configurations) in an effort to promote the liberation of as much fire extinguishing agent as possible from the chamber. By placing the agent into one chamber, the fracture-arresting properties inherent in the interfaces between the discrete chambers of the multi-chamber designs are avoided, thereby permitting significant agent escape from as few as one hole in the device. By having the ribs be rigidly connected to the front face, an efficient energy transfer path between the front and rear faces is formed. Thus, upon the front face sustaining damage from an initial absorption of energy (such as, by way of example, through ballistic impact, fire or explosion), the coupling of the rear face, ribs and front face maximizes the transfer of the absorbed energy to the front face to enhance front face fracture damage. The more that energy is transferred to the front face (from direct energy impact, transferred energy from impact of the rear face that travels through the ribs, as well as energy fed back from elastic flexure of the device to which it is attached), the more likely that thorough front face fracture will occur, and consequently the more likely that at least one opening will form in the front face through which any agent present in the chamber may disperse.

Optionally, the dual wall enclosure or fire protection device may be designed in a flat panel form or in a curved form to conform to the structure to which it is attached. Examples of such structure include (but are not limited to) flammable material containers, such as fuel tanks, fuel, lubricant and hydraulic fluid supply lines and related conduit, and explosive or ordnance containers and housing. In the present context, the term "flammable material containers" can be used generically to encompass all of the above examples. Such structure can further include mobile platforms, such as aircraft or automotive fuel bays, or stationary platforms, such as a building surrounding a fuel farm or ordnance or explosives supply. In another option, the ribs are integrally formed with the rear face, thereby promoting an even more efficient energy transfer path. Moreover, the ribs can be adhesively bonded to the front face, while the front face can be prestressed, thereby further enhancing fracture damage upon exposure to the absorbed energy. In one configuration the front face is made of a material that is more brittle than the rear face, where the percent elongation of the material and impact strength are easily quantifiable. For example, the former can be measured by ASTM D 638, while the latter can be measured by the notched Izod test ASTM D 256, both of which are industry-accepted standardized tests. In another configuration, the rear face can be made to be substantially as brittle as the front face. This could be useful in situations where the device is not in direct contact with the flammable material structure so that agent can escape through the rear face as well as the front face. In the present context, the term "substantially" refers to an arrangement of elements or features that, while in theory would be expected to exhibit exact correspondence or behavior, may in practice embody something slightly less than exact. As such, the term denotes the degree by which a quantitative value, measurement or other related representation may vary from a stated reference without resulting in a change in the basic function of the subject matter at issue. In another configuration, the rear face is made up of a material configured to maximize feedback of the absorbed energy through the plurality of ribs and the front face. This could be, for example, a relatively strong, tough material that can withstand significant loading, deformation or the like.

In another configuration, the ribs and rear face are made from a material that imparts self-sealing features to the device. Examples of such materials include elastomers, of which rubber or related highly deformable materials are suitable, and ionomers, which are sometimes referred to as thermoplastic elastomers. As a variation, the device can further include a layer of self-sealing material disposed adjacent the rear face. As just mentioned, this self-sealing material may be composed of an elastomer or ionomer. Regardless of whether or not the self-sealing feature is included, the chamber may additionally be pressurized relative to the ambient environment, such that upon a breach in one or both of the faces, the excess internal pressure facilitates agent dispersal to the lower ambient pressure of the adjacent area. To promote secure positioning between the fire protection device and the flammable material container, at least one mounting device can be included to secure the fire protection device adjacent the flammable material container. In a more particular configuration, the ribs are defined by size, inter-rib spacing and shape to promote the aforementioned enhanced fracture damage to the front face. Furthermore, the coupling of the ribs to the front and rear faces is of sufficient strength to ensure the front face fractures prior to the connection between the ribs and the front face.

According to another aspect of the invention, a fire protection device includes a front face made of a first material, a rear face made of a second material that is more resistant to fracture than the first material, and a plurality of ribs integrally formed with the rear face and coupled to the front face such that the ribs, front face and rear face are arranged to define a single chamber into which a fire extinguishing agent can be disposed. The construction is similar to that of the previous aspect, with the exception that the ribs and rear face are integrally formed with one another.

According to still another aspect of the invention, a fire protection device includes a front face, a rear face spaced relative to the front face, and a plurality of ribs rigidly coupling the front face to the rear face to define an energy transfer path in a manner similar to that of the first aspect. Upon sustaining projectile damage to the front face (such as through ballistic impact), the coupling maximizes the transfer of energy absorbed as a result of the penetration of the projectile to the front face to enhance fracture damage thereto, thereby liberating as much of the agent as possible.

According to yet another aspect of the invention, a fire protection device for a flammable material disposed in a container includes a front face, a rear face spaced relative to the front face such that a fire extinguishing agent can be placed between them, a sealing layer disposed between the rear face and the container, and a plurality of ribs coupling the front face to the rear face. As with the previous aspects, the configuration of the device defines a single chamber to hold fire extinguishing agent, while the coupling made possible by the rib and face connection maximizes the transfer of the absorbed energy to the front face to enhance front face fracture damage. Optionally, the sealing layer is made of an elastomer or ionomer or related material responsive to a rupture forming in the container adjacent the sealing layer such that the amount of leakage of the material from the container is reduced. One example of such a compound is rubber, although it will be appreciated that others, including intumescent materials that expand under heat exposure, could also be employed. In an optional embodiment, the rear face, sealing layer and container are in contact with one another.

According to another aspect of the invention, a fuel system includes a fuel container and a fire protection device coupled to the fuel container. The fire protection device is substantially similar to that discussed in conjunction with the previous aspects of the invention. The fire extinguishing agent can be in powder, gaseous or liquid form. Similarly, the chamber can be pressurized relative to the ambient environment. In one form, the fuel container is connected to the fire protection device such that the energy due to a hydrodynamic ram (which could arise from, for example, a ballistic impact, explosion or related overpressure in or around the fuel container) developed in the fuel container is efficiently transferred to the front face through the rear face and the ribs to effect extensive damage to at least the front face of the fire protection device. Also as previously discussed, a self-sealing feature can be included, either as a separate layer or integral with the ribs and rear face.

According to yet another aspect of the invention, a flammable material storage system includes a containment structure configured to house a flammable material and a fire protection device coupled to the containment structure. The fire protection device is generally similar to that described in the first aspect. In one form, the containment structure is a building. It will be appreciated that other containment structures are contemplated, including (but not limited to) automotive and aircraft fuel tanks, as well as explosive, ordnance (and related munition) storage containers. It will further be appreciated that the larger class of vehicles that qualify as "automotive" can include cars, trucks, motorcycles, construction vehicles, trains or related transportation machinery, and that all are deemed to be within the purview of the present disclosure.

According to another aspect of the invention, a method of extinguishing a fire includes the steps of arranging a fire protection device that is configured similar to that of the previous aspects, and placing the fire protection device adjacent a container of the flammable material such that upon the front face of the fire protection device sustaining damage from an initial absorption of energy, the coupling between the front and rear faces and ribs maximizes the transfer of the absorbed energy to the front face to enhance the fracture damage to the front face, thereby liberating as much of the agent contained within the device as possible. Optionally, the fire protection device can include a material that imparts self-sealing features to the device, where such material can be used for the rear face, ribs or both. As previously discussed, the material that imparts self-sealing features may be formed as a separate sealing layer disposed between the rear face and the flammable material container.

DETAILED DESCRIPTION OF THE PREFERRED EMBODIMENTS

Figure 1A:
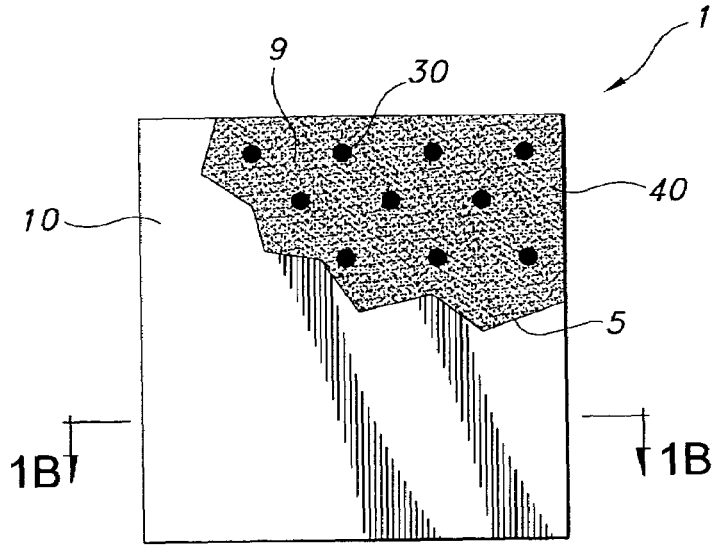
FIG. 1A shows a plan view of a panel according to an embodiment of the present invention, including a cutaway view in the front face showing an internal rib structure and placement of a fire extinguishant.
Figure 1B:
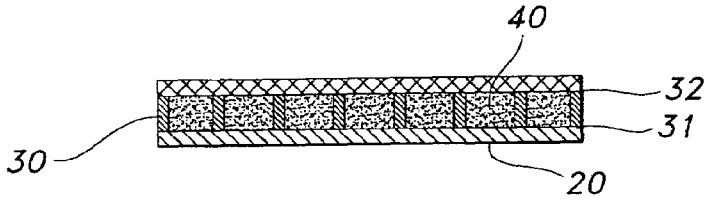
FIG. 1B shows an elevation section along lines 1B—1B of FIG. 1A.
Figure 1C:
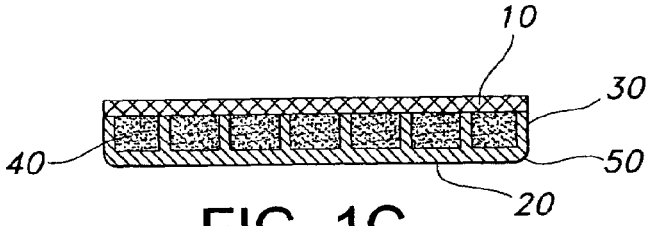
FIG. 1C shows yet another embodiment of the present invention, where the internal rib structure is integrally formed into a rear face and the front face is bonded to the rib structure.
Figure 1E:
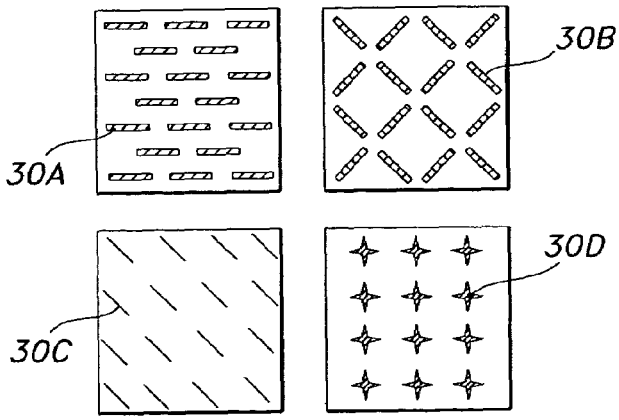
FIG. 1E shows several variations of the internal rib structure of the embodiment of FIG. 1D.
Figure 1D:
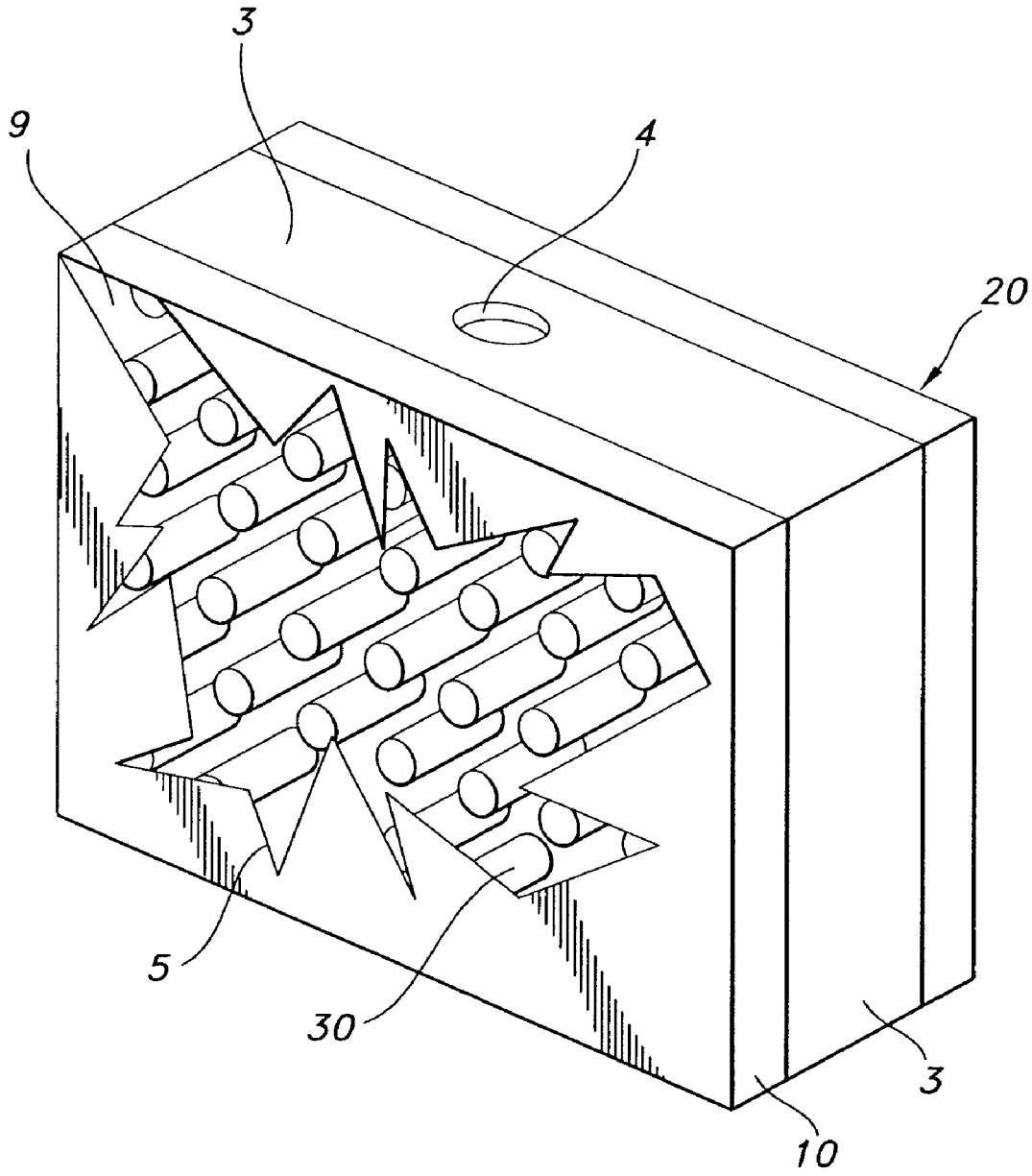
FIG. 1D shows a rib-impact view of the embodiment of FIG. 1A, detailing how the internal rib structure can be designed to allow a direct path of travel for substantially all of the fire extinguishant to exit a void created in the face of the panel.

Referring first to FIGS. 1A through 1E, an embodiment of the invention is shown, where panel 1 includes front face 10, rear face 20 and internal ribs 30. The front face 10 is defined as the face open to the anticipated fire zone, where flammable fluids or combustible materials may interact with ignition sources in a relatively open space. The rear face 20 is defined as the face opposite the fire zone, and which may be attached to a flammable material container through adhesive or mechanical attachment means, neither of which are presently shown. The two faces 10, 20 are separated by the internal ribs 30 such that a single chamber 9 for placing fire extinguishing agent 40 between them is defined. Referring with particularity to FIG. 1A, the intent of the single chamber 9 is to ensure access from every space within the chamber 9 to the ambient environment such that even if subsequent damage to front face 10 were to be limited to but a single hole, all of the agent 40 disposed within the chamber 9 would have a chance to escape. The front face 10 is preferably composed of a brittle or low ductility material, where elongation is preferably between 0% and 5% prior to failure. Thermoplastic, thermoset, or composite materials can be used for the front face. Examples include, but are not limited to, polystyrenes, polymethyl methacrylate, and polyester or epoxy resins, with or without fiber reinforcement. The front face 10 is preferably formed separately from the ribs 30 and rear face 20 to maximize the potential for fracture and separation, which maximizes the dispersion of fire extinguishing agent 40. Bond sites 31, 32 show possible connection points between the ribs 30 and respective faces 10, 20. Although liquid and even gaseous agents can be used, solid powder agents have been found to be suitable, as they combine low cost with ease of handling and dispersal. Referring with particularity to FIG. 1D, a stylized fracture is shown in front face 10 being formed along crack 5 such that a portion of front face 10 has been removed, thereby exposing single chamber 9 and the agent 40 disposed therein to the ambient environment. In addition, ends 3 of panel 1 can be sealed by separate pieces or caps or can either be integrally formed with or connected to the rear face 20. While a number of different materials can be used for ends 3, the use of a material similar to that of the rear face 20 or ribs 30 would be suitable. The use of strong bonding agents to join the ends 3 can promote relatively sealed panels 1, thereby providing additional assurance against leakage due to manufacturing tolerances, corrosion or other concerns. This can be beneficial in the event that certain fire extinguishing materials that have mildly corrosive properties might be employed. One of the ends 3 may include a fill port 4 to improve the ease with which agent 40 may be added to chamber 9. This method of filling can greatly simplify the assembly process over multi-chamber fire protection devices (such as those configured with numerous discrete channels or honeycombs), as only a single filling operation is necessary. In situations where a gaseous agent 40 is used, a valve (not shown) can be coupled to port 4 to allow the panel to be filled and pressurized.

The rear face 20 can be composed of a brittle or low ductility material similar to the front face 10, or it can be composed of a number of different material classes, depending upon the application. For example, the rear face 20 can be designed to be frangible, particularly when leakage of fire extinguishing agent 40 may be desired on either side of the panel 1. When positioned in areas where it cannot be abutted up against a flammable material container, a brittle (shatter-prone) rear face 20 would be beneficial in dispersing agent 40 into the open space between the rear face 20 and the container. By way of an opposing example, the rear face 20 may be designed to resist fracture, such as being made of high strength, toughened material, so that when energy is imparted to the rear face 20 (such as movement of the rear face 20 due to an impact, overpressure or related disturbance), the energy can be transferred through the rear face 20 to the ribs 30 and ultimately the front face 10).

Figure 2:
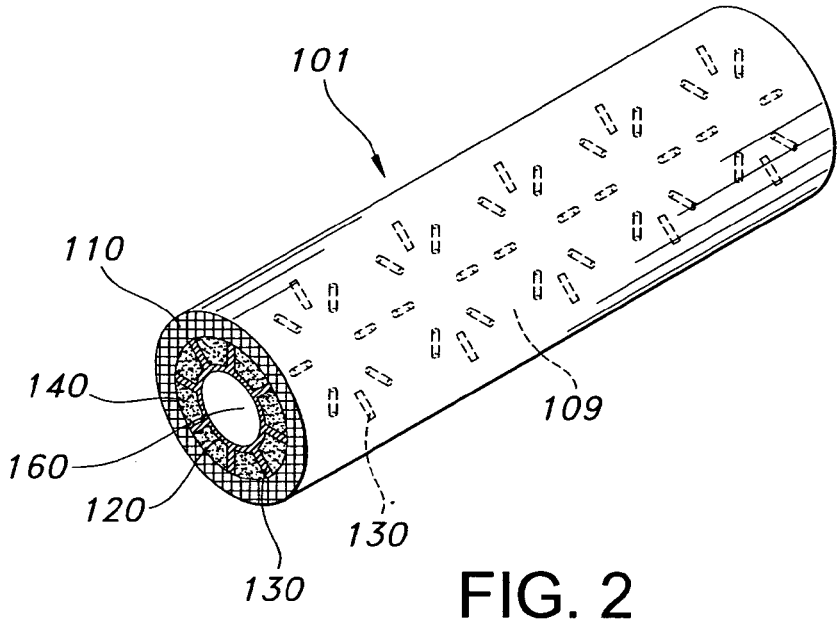
FIG. 2 shows a curved embodiment of the present invention.

Referring next to FIG. 2, an alternately-shaped embodiment shows panel 101 now configured in a tubular shape. Outer face 110 surrounds ribs 130, rear (now inner) face 120, and fire extinguishing agent 140 such that a central hollow bore 160 extends through panel 101. This configuration is particularly well-suited for flammable material conduit and related piping, where the flammable material (such as fuel, lubricant, hydraulic fluid or a process chemical) may be flowing through the conduit. As with the embodiment shown in FIGS. 1A through 1C, the arrangement of the ribs 130 and faces 110, 120 defines a single chamber 109 to facilitate liberation of as much agent 140 as possible, even in situations where damage to the front or rear faces 110, 120 were limited to a single hole.

Figure 3:
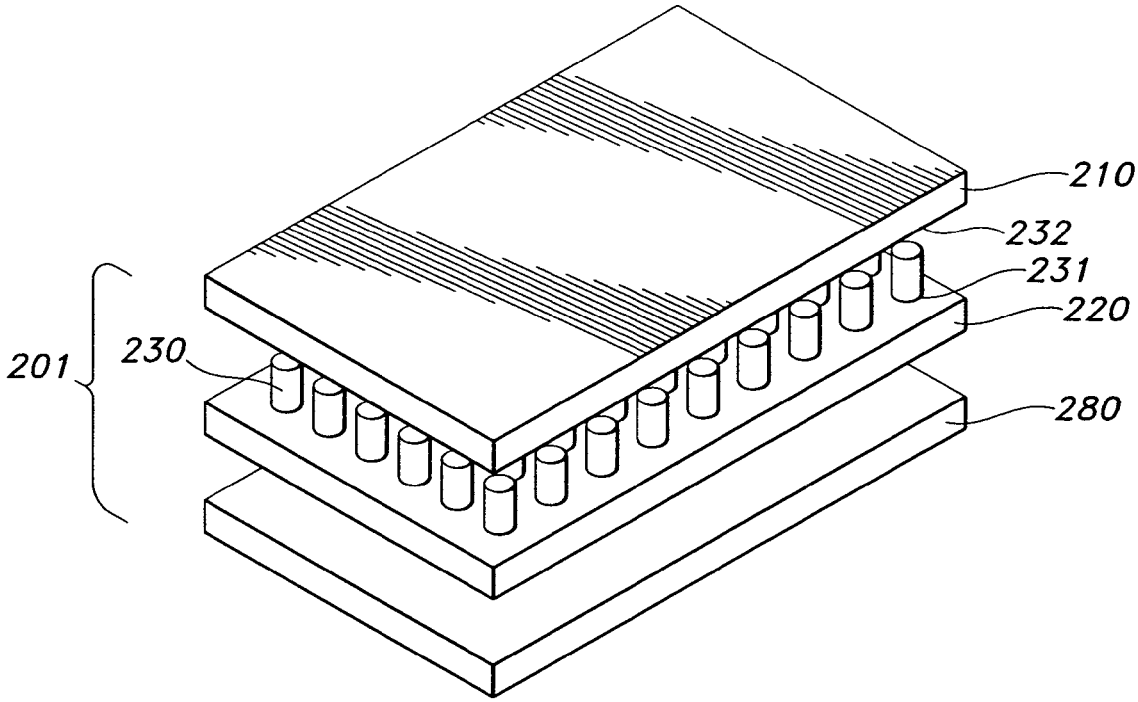
FIG. 3 shows an exploded view of yet another alternate embodiment of the present invention, where a separate self-sealing layer is employed.

Referring next to FIG. 3, an alternate embodiment of the panels shown in FIGS. 1A through 1E is shown, where in yet another example of potential rear face 220 configurations, a self-sealing material 280 can be included. For the sake of visualization, ends (i.e., sidewalls) are removed from the present figure, although it will be appreciated that such ends are preferably included in the panel to define a substantially closed container for the fire extinguishing agent. This configuration is particularly beneficial when the panel 201 is disposed adjacent a flammable material container such that rear face 220 abuts the container wall. The nature of the self-sealing feature is that when the panel 201 is placed adjacent to a flammable material container that subsequently ruptures, self-sealing materials (including, but not limited to ionomers, elastomers or intumescent materials) can expand under heat exposure to plug up the rupture, thereby inhibiting further leakage of the flammable material. Other impact resistant materials, such as polycarbonate, or ductile materials, such as acrylo-butadiene styrene (ABS), could also be used. In the embodiment shown in the figure, the self-sealing material 280 is formed as a separate layer that can be affixed to rear face 220 of panel 201. An equally suitable approach can be employed where self-sealing material 280 could be the main ingredient in the ribs 30 and rear face 20 shown previously in the embodiments of FIGS. 1A through 1C. In both the embodiment shown in the present figure, as well as that of FIGS. 1A through 1C, the rear face 220 is coupled to the front face 210 through bond sites 231, 232 on the internal ribs 30; it does not inhibit the fracture of the front face 10 and release of fire extinguishing agent 40 in the preferred direction. The rear face 20 can be varied in thickness depending upon weight and durability considerations. In this self-sealing configuration, energy can be transferred from the flammable material container either through the ribs 30 or directly to the front face 10. As previously mentioned, the rear face 20 and ribs 30 may be formed independently, but using a common material.

Referring again to FIGS. 1A through 1E, and as with the rear face discussed above, the ribs 30 separating the front face 10 from the rear face 20 can be composed of a number of different materials. In one configuration, they can be formed through a mold or extrusion process integrally with the rear face 20 (as shown with particularity in FIG. 1C, where together ribs 30 and rear face 20 define the integral portion 50) or formed separately and bonded to both faces 10 and 20, as shown with particularity in FIG. 1B. Even if the ribs 30 are formed independent of the front or rear faces 10, 20, they may still be made from the same material as these faces. For example, impact-resistant materials (high Izod impact strength value) would be suitable for assisting in break-up of the front face 10. The stiffness of these materials would assist in transferring absorbed energy back to the front face 10. In this regard, the ribs 30 can be "tuned" (through proper size, shape, and spacing) to maximize the transference of impact, pressure or thermal energy back to the front face. While the ribs 30 can be composed of many different designs and arrangements, they are preferably formed and placed such that all fire extinguishant 40 contained within chamber 9 has a direct path to any hole or fracture in the front face 10, such as shown with particularity in FIG. 1D. This arrangement allows for the greatest amount of agent 40 to be released from as little as a single hole or fracture created by a projectile penetration, collision with another object, pressure wave impingement, or high temperature exposure. As is shown in the figure, the series of ribs 30 are spaced in offset columns. The length of the ribs 30 runs from the front face 10 to the rear face 20, perpendicular to the faces, with the flat ends being attached to each face. It will be appreciated that other rib designs can be used to manipulate the release of agent 40 in preferential directions or allow for sufficient agent 40 to be released for a particular penetration, yet maintain some of the agent 40 to function again under a separate impact. The primary purpose of the ribs 30, however, is to maximize energy transfer back to the front face at discrete locations, provide structural support, provide separation of the front face 10 from the back face 20 so that fire extinguishing agent 40 can be contained between the faces, and to assist in the prevention of agent 40 settling.

In either form, the ribs 30 are designed to allow all agent 40 or powder within the panel 1 to have direct access to any hole or crack 5 that is created in the front face 10 by ballistic projectile or other mass, collision of another object, pressures due to an explosion, or by opening up due to direct impingement of a heat source. Further, the coupling of the two faces 10, 20 by the ribs 30 is configured to maximize the energy transferred to the front face 10. The method of adhering the panel 1 to another structure (such as a flammable material container or adjoining structure) may be through a bonding agent such as an epoxy or through mechanical fastening means as will be appreciated by those skilled in the art. Design variations of this embodiment may include ribs formed on the outside surface of the rear face (not shown) to avoid distribution of shock waves across the rear face, while attempting to transfer the energy back to the front face through the ribs. Other design variations allow for differently-shaped ribs 30A, 30B, 30C and 30D, as shown with particularity in FIG. 1E. It will be appreciated by those skilled in the art that many such variations are possible that are still within the spirit of the present invention, limited only by being configured to keep panel 1 to the aforementioned single chamber 9 design.

Figure 4A:
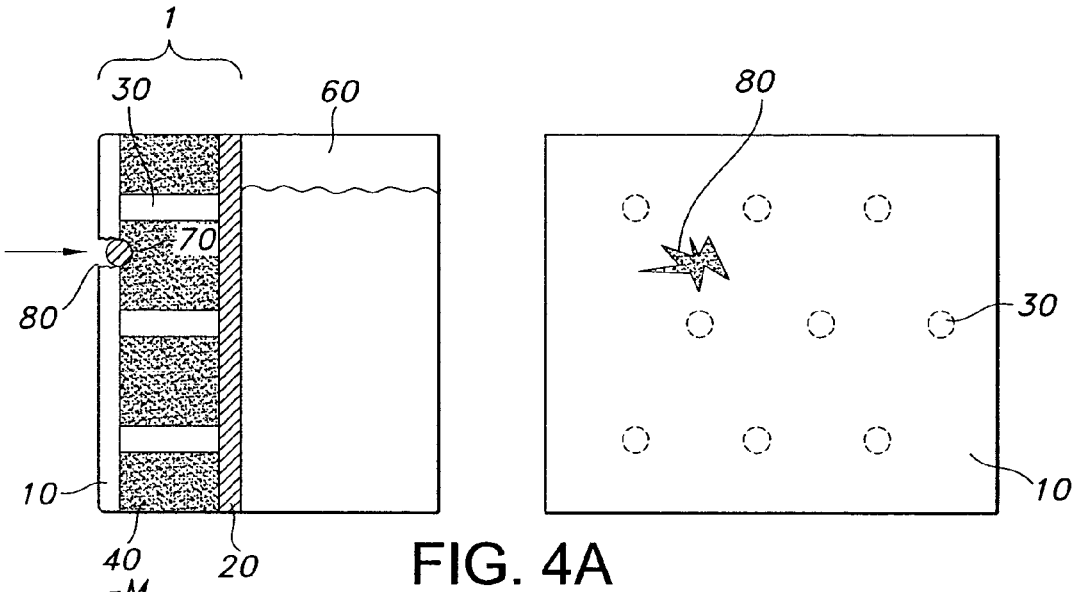
FIGS. 4A through 4C show the varying stages of projectile impact and subsequent front face damage of the panel of FIG. 1A.
Figure 4B:
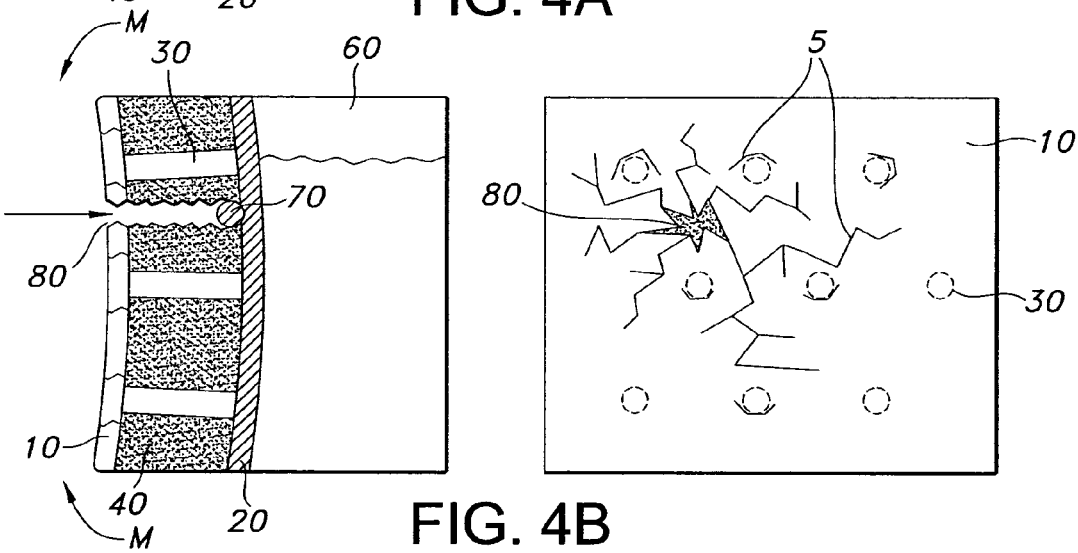
Figure 4C:
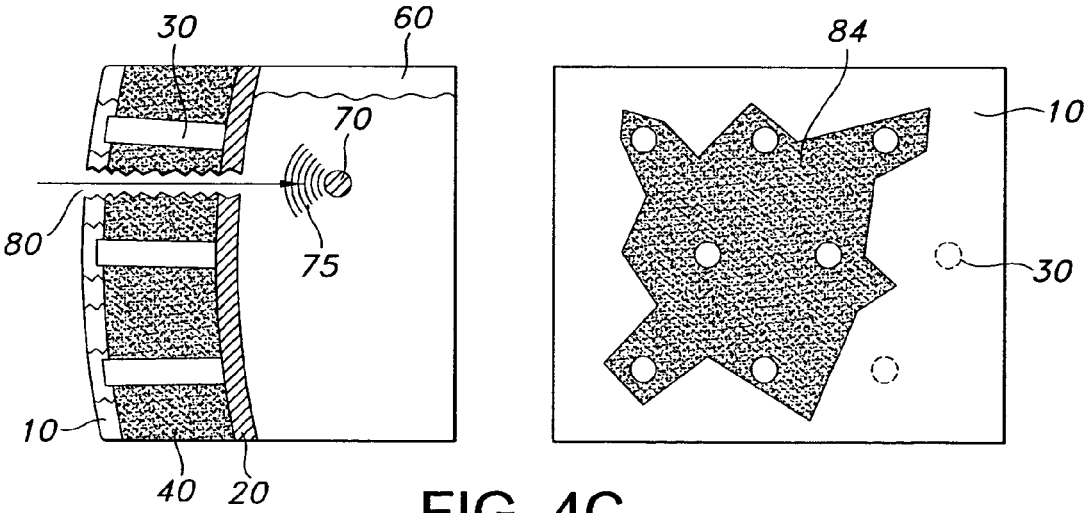

Referring next to FIGS. 4A through 4C, the sequence of events leading up to the extensive fracture and subsequent release of fire extinguishing agent 40 according to an aspect of the present invention is shown. Referring with particularity to FIG. 4A, the initial impact involves a high speed projectile 70 penetrating front face 10, producing a hole 80 therein. As clearly shown in the figure, front face 10 is coupled to rear face 20 through ribs 30. This arrangement helps to transfer energy absorbed in one part of the panel 1 (in the case presently shown on the front face 10) to other parts, and in some situations (such as in the case presently shown) back to the part that suffered the initial absorption of the energy.

Referring with particularity to FIG. 4B, the coupling of the rear and front faces 20, 10 means that the impact of projectile 70 on rear face 20 (which may, for example, be made from a stronger, tougher material than the front face 10) will cause rear face 20 to flex. Since ribs 30 are securely connected to rear face 20 (by either of the aforementioned affixing or integral forming), the flexure of the rear face 20 will pull the ribs 30 along with it, which in turn will pull the securely-coupled front face 10. It will be appreciated that even in situations where the rear face 20 is made from a material substantially as brittle as front face 10, the front face-to-rib-to-rear face coupling will still induce some flexural motion in the panel 1. The relatively brittle front face 10, being not very tolerant of the strain produced therein due to flexural motion M, absorbs the energy by forming cracks 5. Additional energy (such as due to the continued motion of panel 1) causes the cracks 5 to propagate and allow for even greater flexing that can result in critical bending of the front face. As can be seen in the front view, many of the cracks 5 desirably form in areas adjacent the ribs 30. This can be promoted by proper selection of rib size and degree of connectivity between rib 30 and front face 10. For example, a secure bond between the two, in conjunction with a small area footprint of rib 30 can enhance cracking, as load transfer and stress concentration go up under such a configuration. Additional flexing of panel 1 can occur due to hydrodynamic ram forces from the flammable fluid disposed in container 60, as such forces can cause deformation of the container 60 and adjacent panel 1.

Although panel 1 provides crush resistance or load resistance to distributed forces perpendicular to the rear face 20 or ribs 30, it provides less resistance to bending than designs incorporating honeycombed or channeled chambers, where such designs have distributed networks of structural supports that act to resist panel flexure. This distinction is exploited in the present invention to allow the discrete ribs 30 to act independently, thereby offering less resistance to panel 1 bending and consequent critical flexure of at least the front face 10 to be achieved more readily. It will be appreciated by those skilled in the art that panel thickness can be varied, depending on other design constraints, such as cost, weight, amount of fire extinguishing agent required, space available, or the like. In situations where thicker panels 1 are used, further flexure-induced front face 10 damage can occur, even if more distributed ribs 30 or intermittent bonding between the ribs 30 and front face 10 is used. With thicker panels 1, there is more allowance for bending of the front face 10, which may cause it to reach a critical stress level (and thereby fracture) easier. In thinner panels 1, where the front and rear faces 10, 20 are moved closer together, the initiation sites for cracks 5 associated with the securely-bonded ribs 30 are more important because of the reduced front face 10 flexure relative to the thicker panel 1.

Energy from the projectile 70 is transferred to the rear face 20 in the direction of the projectile travel (indicated by the arrow) at the same time that the front face 10 is springing back from the initial impact. As mentioned above, this load on the rear face 20 is transferred to the ribs 30 and front face 10. By making both secure connectivity between the various components of panel 1, as well as the front face 10 out of a material that makes it the weakest link in the panel 1, the absorption of energy initially imparted by the projectile 70 can be concentrated in front face 10 to promote the desirable fracture thereof. As further seen in the front view, cracks 5 form both around the connection locations adjacent ribs 30 and from initial hole 80.

Referring with particularity to FIG. 4C, the projectile 70 penetrates the flammable material container 60. Hydrodynamic ram pressure waves 75 are created in the container 60 as the projectile 70 initially impacts the flammable material (such as fuel) and penetrates through it. The hydrodynamic ram waves push the outer wall of container 60 and panel 1 outward, causing the latter to bow. These high loads (and the attendant strain they produce) on the front face 10 cause further rupture of the panel 1, especially fracture in front face 10. As previously mentioned, the discrete placement of ribs 30 promotes concentration of the energy transferred through the ribs 30 to a limited number of spots on front face 10. The cracks 5 that began forming in FIG. 4B expand and meet up to remove large sections (shown as jagged hole 80) of the front face 10. This energy also is transferred to the fire extinguishing agent 40, facilitating its rapid expulsion from panel 1 in large volumes into the adjacent ambient environment, where it acts to prevent fire ignition or propagation.

Figure 5:
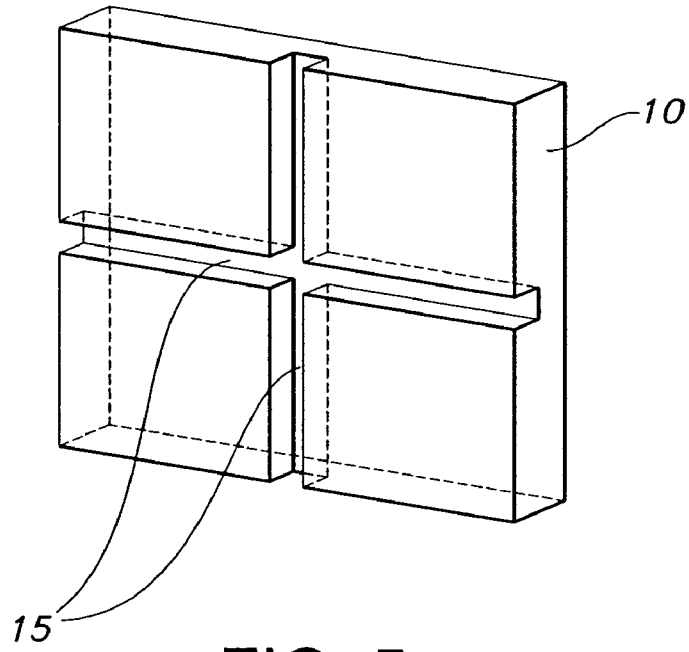
FIG. 5 shows how surface scoring of the front face can be used to enhance or direct fracture to optimize dispersion of the fire extinguishant.
Figure 6:
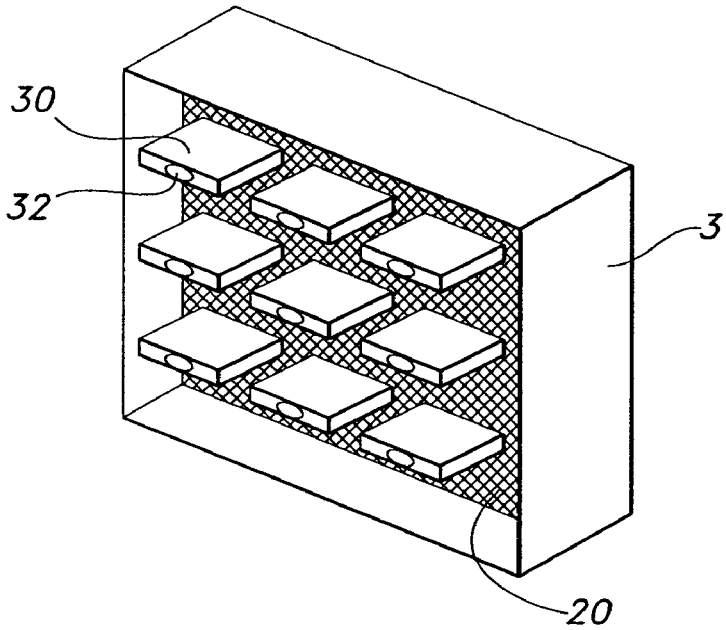
FIG. 6 shows the use of adhesive applied to a rib structure in order to secure the front face to the rib structure.

Referring next to FIGS. 5 and 6, additional tailoring can be performed to optimize the fracture of the front face 10, while maintaining the overall stiffness of the panel 1. For example, referring with particularity to FIG. 6, the aforementioned selective (or weak) bonding of the front face 10 to the ribs 30 (shown presently in an alternate shape) can be used to reduce the chance for stopping crack propagation at bond sites 32. By spot bonding, as well as intermittent bonding, cracks can propagate across ribs 30, allowing more of front face (not presently shown) to be removed. Suitable bonding agents include adhesives, such as epoxy and acrylic. Other bonding agents with less adhesive strength can be used between the front face and ribs 30 to allow the bond sites 32 to break under the load of an impact or pressure wave, when such breakage is desired. In cases where the panel 1 is very thin, strong bond sites 32 may be desirable, as they actually assist in creating fracture sites. Placing such strong bond sites 32 in a more tightly spaced arrangement can promote additional front face fracture prior to bond site 32 failure. It may also be advantageous to strengthen the bonds between the ends 3 to provide strength and durability to other portions of panel 1 to minimize or eliminate the risk of accidental agent leakage. Other front face 10 tailoring is also possible. For example, the front face 10 can be prestressed to further enhance fracture upon impact. For a flat panel, for example, the front face could be formed with a curvature and then forced flat for attachment to the ribs 30. The front face can also be formed in an extrusion process that results in a preferential crack direction; such a crack direction can be oriented to maximize release of the fire extinguishing agent, particularly when the agent is in solid powder form. For example, this can be accomplished by orienting the preferential crack direction vertically when panel 1 is attached to the vertical wall of a flammable material container. Upon impact, the vertical cracking will allow gravity to work with the impulse to ensure the maximum amount of agent is released. Referring with particularity to FIG. 5, another approach that can be used for preferential cracking and area removal is the use of surface scoring 15, where the selective reduction in thickness of certain sites along the surface of front face 10 promotes the formation and direction of cracks formed upon impact or related absorption of energy. Although scoring 15 is shown notionally as cross-shaped, it will be appreciated by those skilled in the art that other configurations are also suitable. For example, tailoring front face 10 with scoring 15 can be used to preferentially aid cracks along the direction of the fillet of ribs 30 or to stop cracks that run from a thicker region of material toward scoring 15. Properly positioned scoring can aid in the removal of segments of the front face during impact.

Figure 7A:
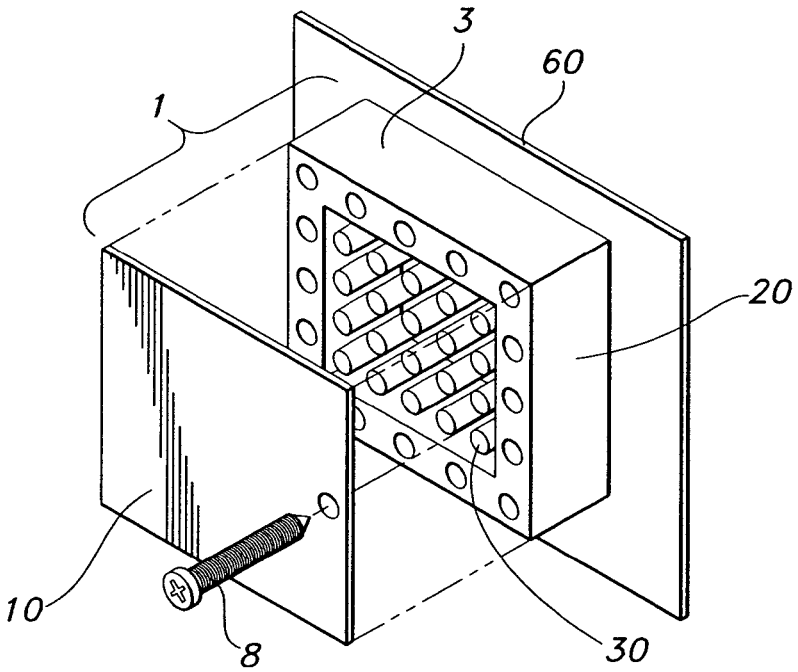
FIGS. 7A and 7B show two methods by which an embodiment of the present invention can be attached to or positioned in proximity to a flammable fluid container or other flammable or combustible source.
Figure 7B:
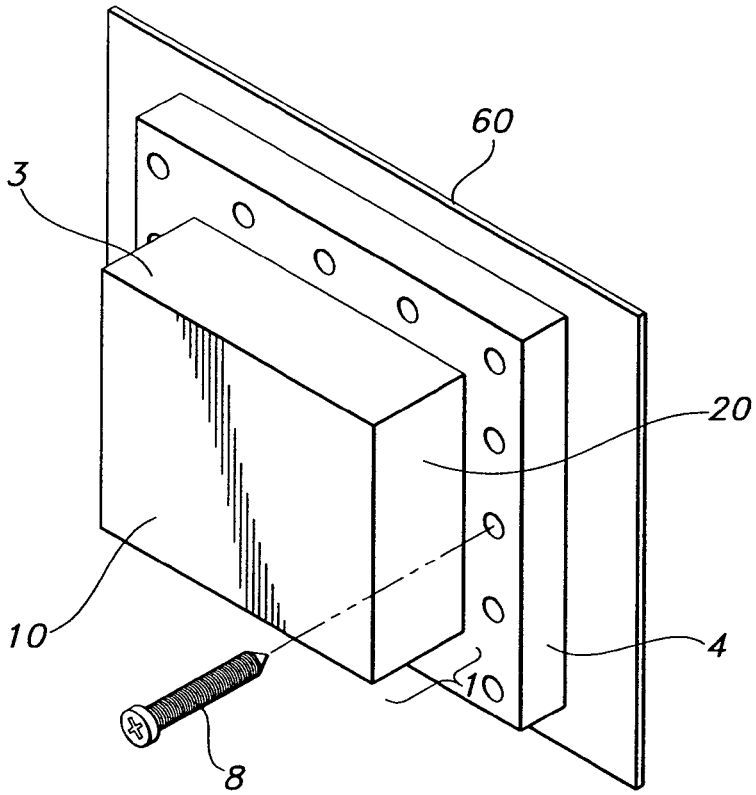

Referring with particularity to FIGS. 7A and 7B, additional attachment schemes between panel 1 and a wall of flammable material container 60 are shown. The ends 3 can be either independent or integrally formed flanges, while panel 1 can be modified to have a thick periphery to allow mechanical fastening (such as through fasteners 8) not just between the front and rear faces 10, 20, but also between panel 1 and container 60. In one attachment scheme, shown with particularity in FIG. 7A, mechanical fasteners 8 can be located through rib sites inside the perimeter of the panel 1. These sites can either be segmented from the remainder of ribs 30 (as shown), or interspersed among the ribs 30. The fasteners 8 can be long enough to penetrate not only panel 1, but also into container 60 (or any other suitable mounting surface). In another attachment scheme, shown with particularity in FIG. 7B, apertures can be added to a flange 4 to allow fasteners 8 to be inserted for attaching the panel 1 to the container 60 or other mountable surface. Such mechanical fastening (in a manner similar to the aforementioned coupling between the ribs and front and rear faces) can be used to ensure more energy is transferred back to the front face 10. As previously discussed, these (as well as the previously described embodiments of panel 1) can also be adhesively bonded to the surface of the flammable material container 60 or other adjacent structure, if desired.

Figure 8A:
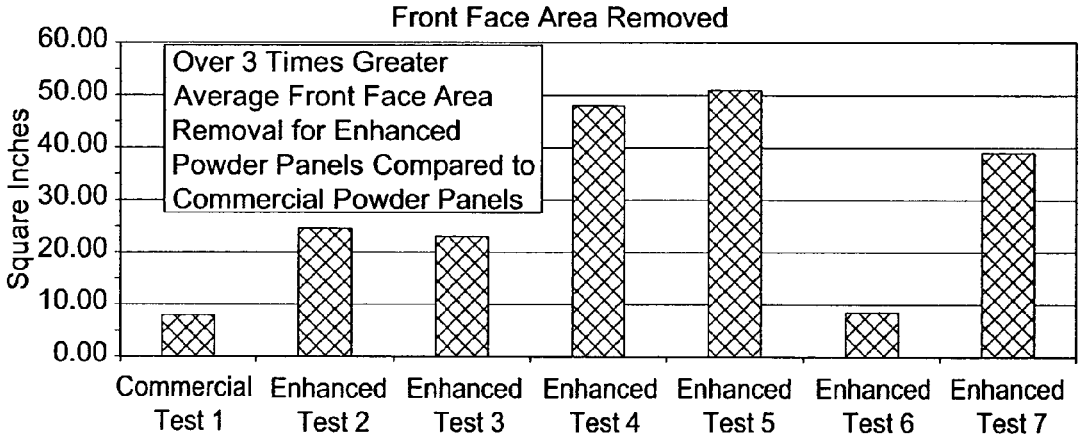
FIGS. 8A and 8B show test results comparing front face fracture area and fire extinguishing agent release of various embodiments of the present invention to a conventional passive fire protection device.
Figure 8B:
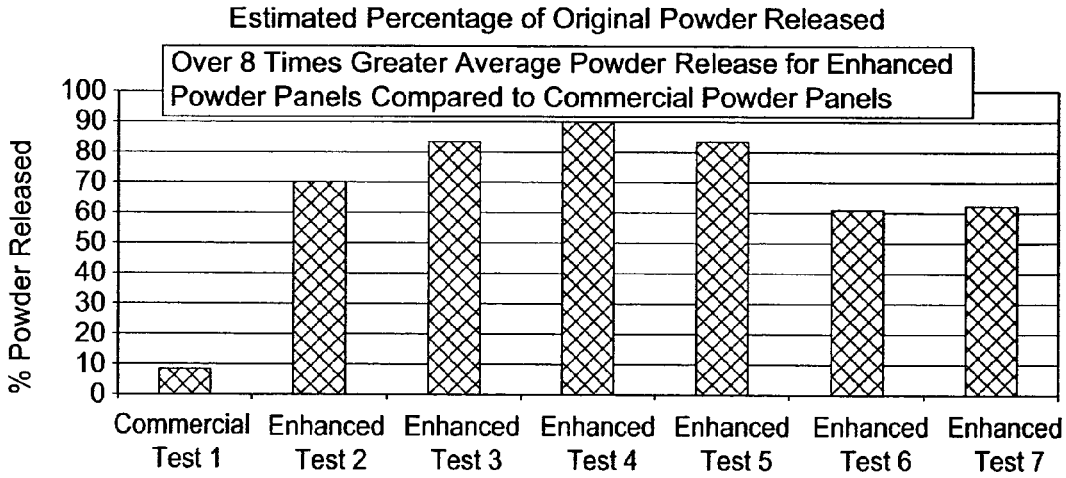

Referring next to FIGS. 8A and 8B, the results of testing on various passive fire protection devices are shown. The devices were configured as square panels, and included fire extinguishing agent 40 in powder form. The panels were placed adjacent a simulated fuel tank, both inside a substantially enclosed text fixture. Projectiles were shot toward the panel and fuel tanks, while high-speed cameras recorded the impact and subsequent events. Among the characteristics examined were fracture and subsequent removal of front face 10 and amount of fire extinguishing agent 40 released into the test fixture. The results of testing on seven panels is shown, where the first panel (entitled "Commercial Test 1") was based on a conventional honeycomb configuration similar to that discussed earlier, while the remaining panels (labelled "Enhanced Test 2" through "Enhanced Test 7", respectively) represented various embodiments of the present invention.

Results of the conventional panel (Commercial Test 1) show the damage area was approximately 4 inches high by 2.5 inches wide, and that approximately 7.75 in of front face was removed. This led to the release of about 8% of the available powder from the chamber.

In the second test (Enhanced Test 2), high-speed video indicated that the enclosed space of the test fixture was engulfed in fire extinguishing powder, and no fire ignition occurred. In addition, a significant amount of airborne powder was also visible in the test fixture for a number of minutes after the test. The damage area was approximately 5.675 inches high by 7 inches wide), with an equivalent front face removal area of approximately 24.25 in.$^2$, while about 70% of the powder was released. The panel design encompassed a 0.02 inch thick carbon/epoxy composite front face 10 and 0.015 inch thick polycarbonate rear face 20. The ribs 30 were 0.04 inch long and 0.025 inch diameter, intermittently spaced at 1.0 inch intervals, and were integrally formed with the polycarbonate material of rear face 20. The ribs 30 were attached to the front face 10 with a urethane-based adhesive. A fast-curing epoxy adhesive was used to attach the panel 1 to the fuel tank.

The next test, involving Enhanced Test 3, showed that the front face 10 damage area was approximately 7 inches high by 6 inches wide, and that approximately 22.55 in.$^2$ of front face 10 was removed, while about 83% of the powder was released. This panel 1 had less of its front face 10 removed; however, the high-speed video indicated that the panel 1 became dislodged from the fixture, and that some of the projectile energy could have been absorbed by shaking the panel 1 loose from its attachment, rather than being absorbed by the front face 10. The panel design and construction technique was identical to Enhanced Test 2, encompassing a 0.02 inch thick carbon/epoxy composite front face 10 and 0.015 inch thick polycarbonate rear face 20. The ribs 30 were 0.04 inch long, 0.025 inch diameter rods, intermittently spaced at 1.0 inch intervals, and were integrally formed with the rear face 20. The ribs 30 were attached to the front face 10 with a urethane-based adhesive. A double-sided tape was used to attach the panel 1 to the fuel tank.

The next test, Enhanced Test 4, involved a different front face material from that used in Enhanced Tests 2 and 3. In this test, a 0.03 inch thick acrylic was used for the front face 10 and again 0.015 inch thick polycarbonate for the rear face 20. The ribs 30 were 0.03 inch long, 0.025 inch diameter rods, intermittently spaced at 1.0 inch intervals, and (as with the previous two panels) were integrally formed with the rear face 20. The ribs 30 were attached to the front face 10 with an acrylic-based adhesive. It also marked the first test using MIL-S-8802 aircraft sealant, rather than a faster curing epoxy sealant, as the adhesive to attach the panel 1 to the fuel tank wall. All subsequent tests also used this adhesive, and all the panels 1 utilizing this sealant remained well adhered to the fuel tank during testing. High-speed video showed that no fire ignition occurred, while post-test inspection showed powder still lingering in the test fixture nearly fifteen minutes after the test. Post-test inspection also showed that the Enhanced Test 4 panel 1 fractured in a similar way to Enhanced Tests 2 and 3. The front face 10 damage area extended nearly to the edges of the panel 1, measuring approximately 11.875 inches high by 10.75 inches wide, resulting in front face 10 area removal of approximately 47.92 in.$^2$. This resulted in about 88% of the powder being released.

In the next test, Enhanced Test 5, $KHCO_3$ was used as the fire extinguishing powder, rather than $Al_2O_3$, to examine any difference in powder release or powder dispersion. The panel in this test used the same design and construction technique as the one in Enhanced Test 4. In this test, however, powder loading was increased and the panel weighed approximately 22% more. In addition, the grain size of the $KHCO_3$ was on average around 30 microns compared to the 5 micron $Al_2O_3$. While previous testing has shown that a smaller grain size is generally more effective in fire extinguishing, it was inconclusive (in the present series of tests) whether or not grain size was even a factor. The resulting fracture was (as expected) similar to that of Enhanced Test 4. The front face 10 damage area extended nearly to edges of the panel 1 again, measuring approximately 11.875 inches high by 10.75 inches wide, giving front face 10 area removal of approximately 51.05 in.$^2$, which resulted in about 83% of the powder being released.

The next test, Enhanced Test 6, utilized $Al_2O_3$ and the same front face material evaluated in Enhanced Tests 2 and 3 (i.e., a 0.02 inch thick carbon/epoxy composite). This test involved the first use of a self-sealing material (Surlyn™) for the rear face. The choice of Surlyn™ was for convenience; it will be appreciated by those skilled in the art that other suitable substitutes could also be used. The ribs 30 were 0.04 inch long, 0.025 inch diameter rods, intermittently spaced at 1.0 inch intervals, and were integrally formed with self-sealing material of the rear face 20. The ribs 30 were attached to the front face 10 with a urethane-based adhesive. This panel 1 was slightly thicker (0.084 inches) than these previously tested panels, but still weighed less than the conventional panel of Commercial Test 1. In this test, the front face 10 area removal was somewhat reduced from previous panels using the same front face 10. Nevertheless, front face 10 cracking was extensive, allowing large flaps of material to easily release powder. The damage area extended about 11.375 inches high by 9.375 inches wide, resulting in front face 10 area removal of approximately 8.39 in.$^2$, resulting in a release of about 61% of the available powder. A hole formed in the rear face 20 of the panel 1 (as with the previous panels), and was approximately 0.05 inch by 0.05 inch, resulting in an area removal about 66% less than any of the other enhanced powder panel tests. It is therefore likely that less fuel was immediately available for fire ignition than in tests without a self-sealing rear face 20.

The final test, Enhanced Test 7, again involved $KHCO_3$ as the fire extinguishing agent. The panel 1 was similar to that of Enhanced Tests 4 and 5, except that the panel internal thickness was greater, thereby increasing the outer thickness to 0.085 inch. In this test, a 0.03 inch thick acrylic was used for the front face 10 and a 0.015 inch thick polycarbonate for the rear face 20. The ribs 30 were 0.04 inch long, 0.025 inch diameter rods, intermittently spaced at 1.0 inch intervals, and were integrally formed with the rear face 20. The ribs 30 were attached to the front face 10 with an acrylic-based adhesive. Despite the increased thickness, powder loading was such that it was very close in weight to the panel 1 of Enhanced Test 5. High-speed video showed that no fire was ignited. A large cloud of powder enveloped the test fixture, and when the fixture side wall was removed more than five minutes after the test, a large cloud of powder was still evident. The damage to the front face 10 was significant, where the damage area extended about 11.875 inches high by 10.125 inches wide, which equated to front face 10 area removal of approximately 39.09 in.$^2$, resulting in about 62% of the powder being released.

The results of the tests show that all of the panel configurations according to the various embodiments of the present invention showed marked improvement in front face 10 fracture and powder release relative to conventional panel designs. In these demonstration tests, the enhanced powder panels 1 released no less than 87% more powder than the panel of Commercial Test 1. Except for the self-sealing panel 1 of Enhanced Test 6 (which still released significantly more powder), the size of the front face 10 area removed was at least 34% better for the enhanced powder panels compared to the commercial powder panel. Of these, the panel 1 utilizing a self-sealing rear face 20 (shown as Enhanced Test 6), while appearing to sustain less front face 10 break-up than other enhanced powder panels 1, still contributed to the panel 1 effectiveness by reducing immediate fuel leakage, thereby demonstrating viability of the self-sealing approach either as a replacement for or supplement to the configuration used in the other Enhanced Tests 2 through 5 and 7. Moreover, sufficient powder was released from each of the enhanced powder panels 1 to significantly reduce the likelihood of a fire, regardless of the powder type. It is estimated that at least 40 grams of powder was released in most of the enhanced powder panel tests, with as much as 60 or 70 grams from the heavier panels, while the commercial powder panel appeared to release less than 10 grams of powder.

Having described the invention in detail and by reference to preferred embodiments thereof, it will be apparent that modifications and variations are possible without departing from the scope of the invention defined in the appended claims.

What is claimed is:

1. A fire protection device comprising:

a front face;

a rear face spaced relative to said front face; and a plurality of ribs coupling said front face to said rear face, wherein said ribs, front face and rear face are arranged to define a single chamber into which a fire extinguishing agent can be disposed, said ribs rigidly connected to said front face and defining an energy transfer path between said front and rear faces such that upon said front face sustaining damage from an initial absorption of energy, said coupling maximizes the transfer of said absorbed energy to said front face to enhance fracture damage thereto, thereby liberating as much of said agent from said chamber as possible.

2. The device of claim 1, wherein said ribs are integrally formed with said rear face.

3. The device of claim 1, wherein said ribs are adhesively bonded to said front face.

4. The device of claim 1, wherein said front face is prestressed, thereby further enhancing fracture damage thereto upon exposure to said absorbed energy.

5. The device of claim 1, wherein said front face is made from a more brittle material than said rear face.

6. The device of claim 1, wherein said rear face is configured to be substantially as brittle as said front face.

7. The device of claim 1, wherein said rear face is made up of a material configured to maximize feedback of said absorbed energy through said plurality of ribs and said front face.

8. The device of claim 1, wherein at least said rear face is made from a material that imparts self-sealing features to said device.

9. The device of claim 8, wherein said material is an elastomer or ionomer.

10. The device of claim 1, further comprising a layer of self-sealing material disposed adjacent said rear face.

11. The device of claim 10, wherein said material is an elastomer, ionomer or intumescent.

12. The device of claim 1, wherein said chamber is pressurized relative to the ambient environment.

13. The device of claim 1, further comprising at least one mounting device disposed thereon to secure said device adjacent a flammable material container.

14. The device of claim 1, wherein said ribs are defined by size, inter-rib spacing and shape such that said size, shape and inter-rib spacing are arranged to promote said enhanced fracture damage to said front face.

15. The device of claim 14, wherein said coupling of said ribs to said front and rear faces is of sufficient strength to ensure said front face fractures prior to said connection between said ribs and said front face.

16. The device of claim 1, further comprising at least one line of weakness in said front face.

17. A fire protection device comprising:

a front face made of a first material;

a rear face spaced relative to said front face, said rear face made of a second material that is more resistant to fracture than said first material; and a plurality of ribs integrally formed with said rear face and coupled to said front face, wherein said ribs, front face and rear face are arranged to define a single chamber into which a fire extinguishing agent can be disposed, said ribs rigidly connected to said front face and defining an energy transfer path between said front and rear faces such that upon said front face sustaining damage from an initial absorption of energy, said coupling maximizes the transfer of said absorbed energy to said front face to enhance fracture damage thereto, thereby liberating as much of said agent as possible.

18. A fire protection device comprising:

a front face;

a rear face spaced relative to said front face; and a plurality of ribs rigidly coupling said front face to said rear face to define an energy transfer path therebetween, wherein said ribs, front face and rear face are arranged to define a single chamber into which a fire extinguishing agent is disposed such that upon sustaining projectile damage to either said face, said coupling maximizes the transfer of energy absorbed as a result of said projectile to said front face to enhance fracture damage thereto, thereby liberating as much of said agent as possible.

19. A fire protection device for a flammable material disposed in a container, said device comprising:

a front face;

a rear face spaced relative to said front face such that a fire extinguishing agent can be placed therebetween;

a sealing layer disposed between said rear face and said container; and a plurality of ribs coupling said front face to said rear face, wherein said ribs, front face and rear face are arranged to define a single chamber into which said agent is disposed, said ribs defining an energy transfer path between said front and rear faces where said front face and said ribs are rigidly connected to one another such that upon sustaining damage to said front face from an initial absorption of energy, said coupling maximizes the transfer of said absorbed energy to said front face to enhance fracture damage thereto, thereby liberating as much of said agent as possible.

20. The fire protection device of claim 19, wherein said sealing layer is made of an elastomeric, ionomeric or intumescent compound responsive to a rupture forming in said container adjacent said sealing layer such that the amount of leakage of said material from said container is reduced.

21. The fire protection device of claim 20, wherein said rear face, sealing layer and container are in contact with one another.

22. A fuel system comprising:

a fuel container; and a fire protection device coupled to said fuel container, said fire protection device comprising:

a front face;

a rear face spaced relative to said front face, said rear face disposed adjacent said fuel container;

a plurality of ribs coupling said front face to said rear face such that said ribs, front face and rear face are arranged to define a single chamber, said ribs rigidly connected to said front face and defining an energy transfer path between said front and rear faces; and a fire extinguishing agent disposed in said chamber, said fire protection device configured such that upon rupture of said fuel container, said coupling between said ribs and said front and rear faces maximizes the transfer of energy imparted from said fuel container to said front face to enhance fracture damage thereto, thereby liberating as much of said agent as possible.

23. The fuel system of claim 22, wherein said chamber is pressurized relative to the ambient environment.

24. The fuel system of claim 23, wherein said fuel extinguishing agent is a gas.

25. The fuel system of claim 22, wherein said fuel extinguishing agent is a powder.

26. The fuel system of claim 22, wherein said fuel extinguishing agent is a liquid.

27. The fuel system of claim 22, wherein said fuel container is connected to said fuel protection device such that a hydrodynamic ram developed in said fuel container is transferred to said front face through said rear face and said ribs.

28. The fuel system of claim 22, wherein at least one of said rear face or ribs is made from a material that imparts self-sealing features to said fuel system.

29. The fuel system of claim 22, further comprising a sealing layer disposed between said rear face and said fuel container.

30. A flammable material storage system comprising:

a containment structure configured to house a flammable material therein; and a fire protection device coupled to said containment structure, said fire protection device comprising:

a front face;

a rear face spaced relative to said front face, said rear face disposed adjacent said fuel container;

a plurality of ribs coupling said front face to said rear face such that said ribs, front face and rear face are arranged to define a single chamber, said ribs rigidly connected to said front face and defining an energy transfer path between said front and rear faces; and a fire extinguishing agent disposed in said chamber, said fire protection device configured such that upon rupture of said fuel container, said coupling between said ribs and said front and rear faces maximizes the transfer of energy imparted from said fuel container to said front face to enhance fracture damage thereto, thereby liberating as much of said agent as possible.

31. The flammable material storage system of claim 30, wherein said containment structure is a building.

32. A method of protecting a flammable material, said method comprising the steps of:

arranging a fire protection device to comprise:

a front face;

a rear face spaced relative to said front face; and a plurality of ribs coupling said front face to said rear face, wherein said ribs, front face and rear face are arranged to define a single chamber into which a fire extinguishing agent can be disposed, said ribs rigidly connected to said front face and defining an energy transfer path between said front and rear faces; and placing said fire protection device adjacent a container of said flammable material such that upon said front face sustaining damage from an initial absorption of energy, said coupling maximizes the transfer of said absorbed energy to said front face to enhance fracture damage thereto, thereby liberating as much of said agent as possible.

33. The method of claim 32, comprising the additional step of configuring said fire protection device to comprise a material that imparts self-sealing features to said device.

34. The method of claim 33, wherein said material that imparts self-sealing features to said device makes up at least one of said rear face or ribs.

35. The method of claim 33, wherein said material that imparts self-sealing features to said device comprises a sealing layer disposed between said rear face and said flammable material container.

* * * * *

UNITED STATES PATENT AND TRADEMARK OFFICE

CERTIFICATE OF CORRECTION

PATENT NO. : 6,948,567 B1
DATED : September 27, 2005
INVENTOR(S) : Cyphers et al.

It is certified that error appears in the above-identified patent and that said Letters Patent is hereby corrected as shown below:

Column 15,
Line 41, "face disposed adjacent said fuel container;" should read -- face disposed adjacent said containment structure; --;

Column 16,
Line 6, "rupture of said fuel container, said coupling between" should read -- rupture of said containment structure, said coupling between --; and
Line 8, "transfer of energy imparted from said fuel container" should read -- transfer of energy imparted from said containment structure --.

Signed and Sealed this

Twentieth Day of December, 2005

JON W. DUDAS
*Director of the United States Patent and Trademark Office*

UNITED STATES PATENT AND TRADEMARK OFFICE

CERTIFICATE OF CORRECTION

PATENT NO. : 6,948,567 B1
APPLICATION NO. : 10/669082
DATED : September 27, 2005
INVENTOR(S) : Cyphers et al.

It is certified that error appears in the above-identified patent and that said Letters Patent is hereby corrected as shown below:

Col. 10, line 62 "in" should read --$in^2$"

Signed and Sealed this

Fifteenth Day of August, 2006

JON W. DUDAS
*Director of the United States Patent and Trademark Office*